US005141107A

United States Patent [19]

Wiedermann et al.

[11] Patent Number: 5,141,107

[45] Date of Patent: Aug. 25, 1992

[54] INFLATABLE, GARMENT-CARRYING BAG

[75] Inventors: Toni Wiedermann, Salzburg, Austria; Norbert Leopoldi, 4180 Marine Dr., Chicago, Ill. 60613

[73] Assignee: Norbert Leopoldi, Chicago, Ill.

[21] Appl. No.: 775,128

[22] Filed: Oct. 11, 1991

[51] Int. Cl.[5] ..... A45C 7/00; B65D 85/18

[52] U.S. Cl. ..... 206/287.1; 206/279; 206/284; 206/290; 190/107; 383/3

[58] Field of Search ..... 206/287, 287.1, 289, 206/290, 291, 284; 383/3; 248/316.1; 211/89, 123, 124

[56] References Cited

U.S. PATENT DOCUMENTS

| | | | |
|---|---|---|---|
| 1,119,986 | 12/1914 | Pleger et al. | 206/287 X |
| 1,454,334 | 5/1923 | Parker | 206/287 X |
| 1,773,565 | 8/1930 | Arnaud | 206/287 X |
| 2,309,399 | 1/1943 | Kohl | 206/287 X |
| 2,805,767 | 9/1957 | Marks | 206/287 |
| 3,572,251 | 3/1971 | Johnson | 206/290 X |
| 3,587,794 | 6/1971 | Mattel | 383/3 X |
| 3,707,225 | 12/1972 | Miles et al. | 206/287 X |
| 4,044,867 | 8/1977 | Fisher | 383/3 X |

FOREIGN PATENT DOCUMENTS

| | | | |
|---|---|---|---|
| 651180 | 10/1928 | France | 206/287 |
| 119475 | 8/1947 | Sweden | 206/290 |
| 206398 | 11/1939 | Switzerland | 206/287 |
| 440673 | 1/1936 | United Kingdom | 206/287 |

*Primary Examiner*—Sue A. Weaver
*Attorney, Agent, or Firm*—Milton S. Gerstein

[57] ABSTRACT

An inflatable garment bag having an annular air-chamber formed by two interior layers. An air pump is secured to the inner, interior layer for inflating the bag. The two interior layers are clamped together at upper portions thereof by means of a pair of clamping blocks, which blocks also mount the hanger element of the bag by which the bag may be hung in a closet, on a rack, and the like. The lower block also mounts a horizontal bar by which garments may be hung in the bag.

10 Claims, 3 Drawing Sheets

INFLATABLE, GARMENT-CARRYING BAG

BACKGROUND OF THE INVENTION

The present invention is directed to a carrying bag for transporting garments, such as suits, dresses, and the like, which garments are hung or suspended from a hanger. The carrying bag of the invention is intended for use during travel, like a suitcase. When suitcases and other garment-carrying bags are not being used, they must be stored, thereby taking up storage space that may be better used. In addition, finding a storage space for the carrying bag may, at times, be difficult. Also, conventional carrying bags, such as suitcases, may not protect the items stored therein during travel, which is especially so for fragile items, such as glass, and the like.

SUMMARY OF THE INVENTION

It is the primary objective of the present invention to provide a garment-carrying bag that is especially suited for carrying and transporting garments that are suspended from hangers, in a safe and easy manner, which garment-carrying bag is easily stored when not used.

It is the objective of the present invention to provide a garment-carrying bag that is inflatable, so that when not needed, it may be stored in a deflated state, and when needed, it may be easily and readily inflated.

It is an objective of the present invention to provide a garment-carrying bag that, owing to its inflatable nature, will also provide a protective air-cushion for the contents therein.

It is a primary objective of the present invention to provide a garment-carrying bag that has a hanger element, used for suspending the garments in the bag, which hanger element assists in providing an air-seal for sealing pressurized air in the annular portion of the bag.

BRIEF DESCRIPTION OF THE DRAWINGS

The invention will be more readily understood with reference to the accompanying drawing, wherein.

DETAILED DESCRIPTION OF THE INVENTION

Figure 5:
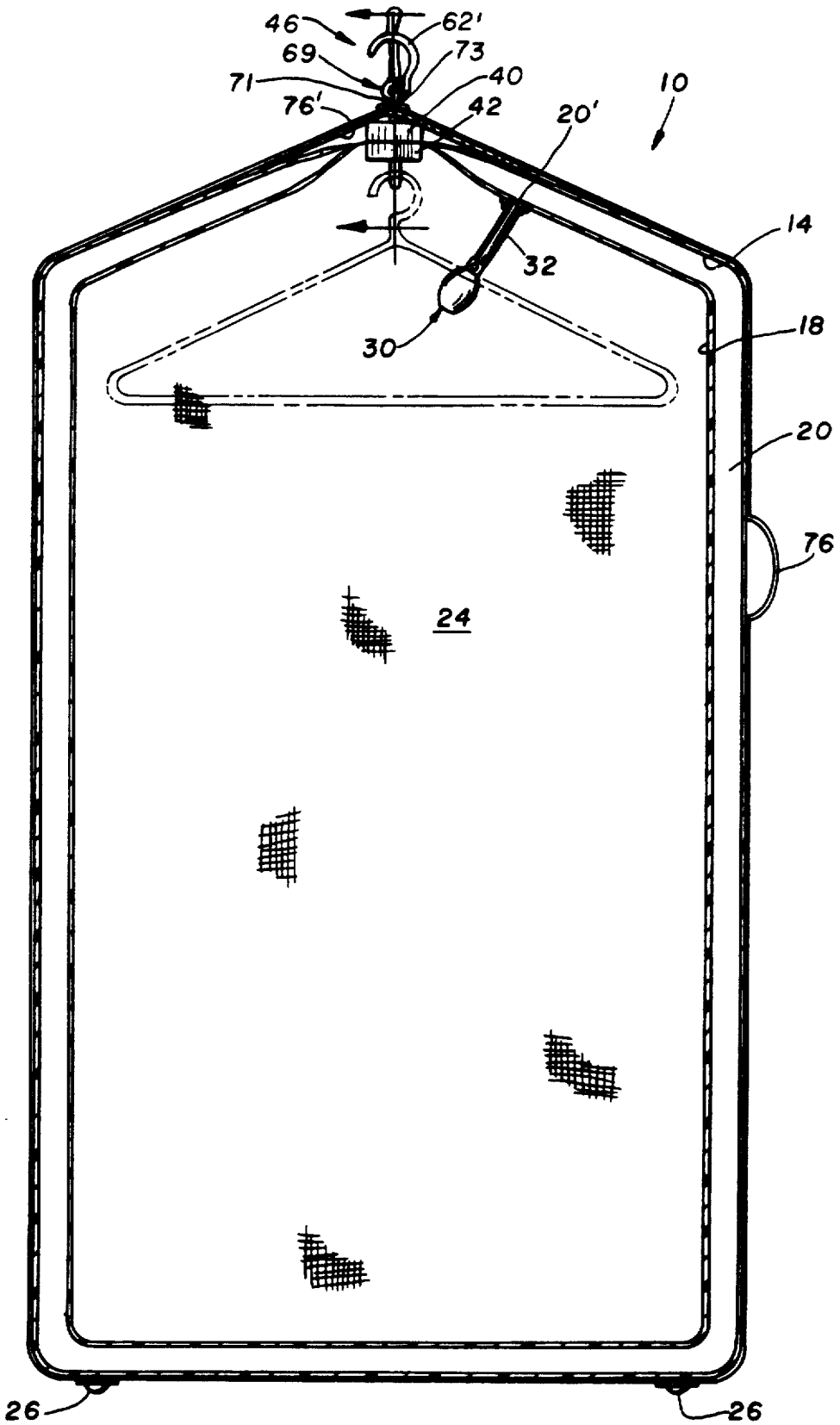
FIG. 5 is a cross-sectional view taken along line 5—5 of FIG. 2.

Referring now to the drawings in greater detail, the inflatable garment-carrying bag is indicated generally by reference numeral 10. The garment-carrying bag 10 defines an annular surface that is made of three layers: A main, outer, protective-shell layer 12 made of nylon, and the like, and a pair of interior layers that form a sealed chamber by which the bag 10 is inflated, which pair of interior layers are an outer, interior layer !4 which is adhesively bonded, or otherwise secured, along most of its area to the interior-facing surface of the protective-shell outer layer 12, and an inner, interior layer 18, which, in the inflated state of the bag 10, is spaced from the outer, interior layer 14 for most of the surface thereof, to thereby define an annular volume 20 for receiving compressed air for inflating the bag 10. The two interior layers 14, 18 are clamped together at upper portions thereof, as seen in FIG. 5, by means of a pair of wooden blocks, which sandwich therebetween the upper portions of the two interior layers, in order to form a closed air chamber, as set forth in greater detail below. The annular surface of the bag is joined by a front wall surface 22 and a rear wall surface 24, both also preferably made of nylon material, whereby, upon evacuating the compressed air from the annular chamber, the bag 10 will easily and readily collapse, and be formed into a small bundle for storage. The front wall surface 22 is also preferably formed with a zipper 24', in conventional fashion, by which the interior volume of the bag 10 may be accessed. The bag 10 also has conventional pads 26 projecting from the outer surface of the outer, protective-shell layer 12, which supports the inflated bag 10 in a vertically-erect position. Additional conventional carrying aids may be provided, like strap 74 and side handle 76.

A conventional hand pump 30 is operatively coupled to the annular compressed-air chamber 20 via a plastic-tube passageway 32, by which compressed air is forced into the annular compressed-air chamber. A small opening 20' is formed in the inner, interior layer 18 that communicates with the interior of the passageway 32, in order to allow the compressed air into the annular chamber. The end of the passageway 32 is adhesively bonded to inwardly-facing portions of the inner, interior layer 18, as clearly shown in FIG. 5.

The bag 10, as mentioned above, is provided with a pair of wooden blocks 40, 42 which are movable toward and away from each other, whereby the upper portions of the two interior layers forming the air chamber may be sandwiched therebetween and held securely thereby, to provide an air-tight chamber 20, and also in order to mount a hanger element 46 thereby. The lower block 42 is provided with a pair of diametrically-opposed elongated holes 50, 52 which receive therethrough vertical legs 54, 56, respectively, of garment-suspending member 58, which legs 54, 56 are interconnected by downwardly-spaced, horizontal leg 60, which leg 60 is used for suspending hangers upon which garments, such as suits, are draped. The upper ends of the vertical legs 54, 56 are threaded for receiving nuts 62, 64, respectively, by which the member 58 is secured to the lower block 42. The nuts 62, 64 are preferably received in recessed areas in the upper surface of the lower block, so that the nuts do not interfere with the mutually-facing clamping surfaces of the blocks 42, 40. Both blocks 40, 42 also have a central through-passageway 66, 68, respectively, which are in colinear alignment, which pass therethrough a threaded shank 70 of hanger element 46. A pair of nuts 72, 74 are threadingly received on the threaded shank 70, one above the upper block 40, and one below the lower block 42, whereby upon tightening the nuts 72, 74, the two blocks 40, 42 are urged toward each other in a clamping manner for sandwiching and clamping therebetween the upper portions of the two interior layers 14, 18, as above-described, which nuts 72, 74 also, thereby, mount the hanger element 46 to the wooden blocks 40, 42. Each nut 72, 74 may be received in recessed, cutout portions formed in the respective blocks, as clearly seen in FIG. 4. The lengths of the blocks 40, 42 and the length of the horizontal suspension bar or leg 60 extend laterally along the thickness of the bag, as measured from the front surface 22 to the rear surface 24, so that garments hung therein may use the entire width of the interior volume.

Figure 2:
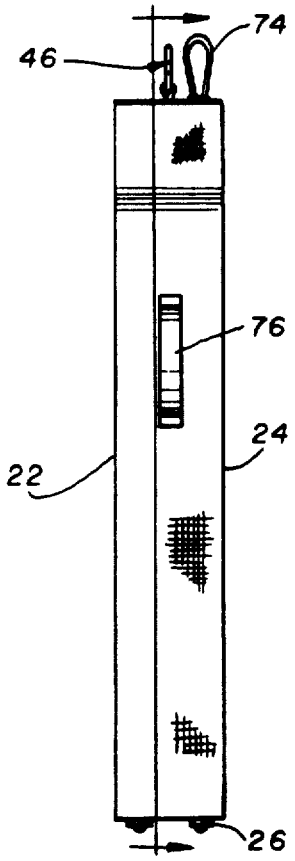
FIG. 2 is a side elevational view thereof.
Figure 1:
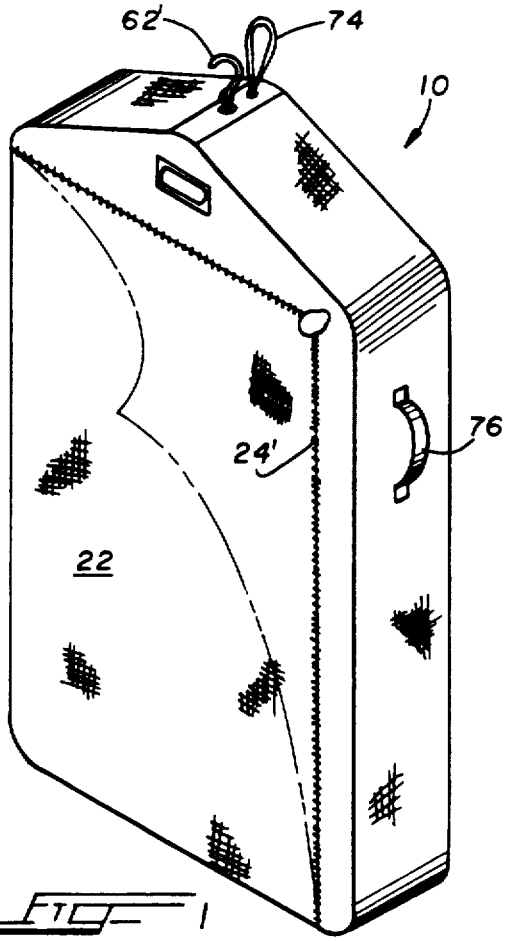
FIG. 1 is a perspective view of the inflatable garment-carrying bag according to the invention.
Figure 3:
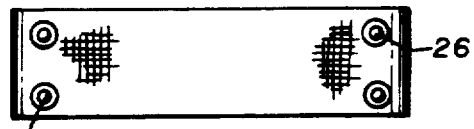
FIG. 3 is a bottom view thereof.
Figure 4:
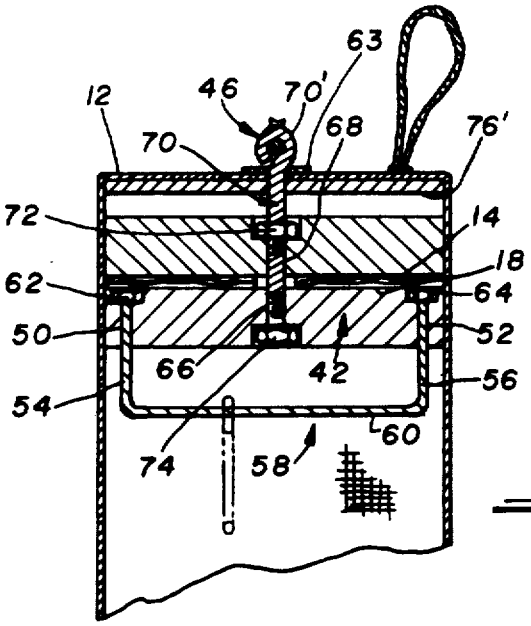
FIG. 4 is a cross-sectional view taken along line 4—4 of FIG. 5.

In order to provide greater structural integrity to the bag 10, an aluminum stiffener plate 76' is provided in the top of the bag between the protective-shell outer layer 12 and the outer, interior layer 14, as best seen in FIGS. 4 and 5. The upper surface of the upper block 40 abuts against this stiffener plate, at the upper corners of the block, as seen in FIG. 5, whereby, when the bag 10 is lifted up or supported by the hanger element 46, the forces are borne by this stiffener plate.

The hanger element 46, by which the bag 10 may be suspended in a closet, or the like, has a hook portion 62', which hook portion 62' has a lower hook 69 that is received through an upper eyelet 70'0 formed on the upper end of the threaded shank or shaft 70. As seen in FIG. 5, the hook 69 allows the hook portion 62' to rotate only in the forward and rearward directions when viewing FIG. 5, whereby the hook portion 62' may be folded down when the bag is not being used. Rotation of the hook portion 62' in the lateral directions is effectively prevented by the camming extensions 71, 73 formed in either side of the spiral hook 69, which interfere with the rotation of the hook portion 62' by contacting the upper surfaces of the bag proper. Gusset plate 63 provides additional strength to the outer surface of the outer, protective layer at the site of the eyelet 70' and hook 69.

Figure 6:
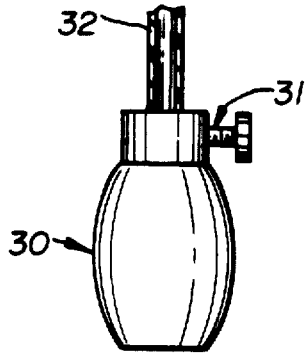
FIG. 6 is a plan view of a hand pump use to inflate the bag of the invention.
Figure 7:
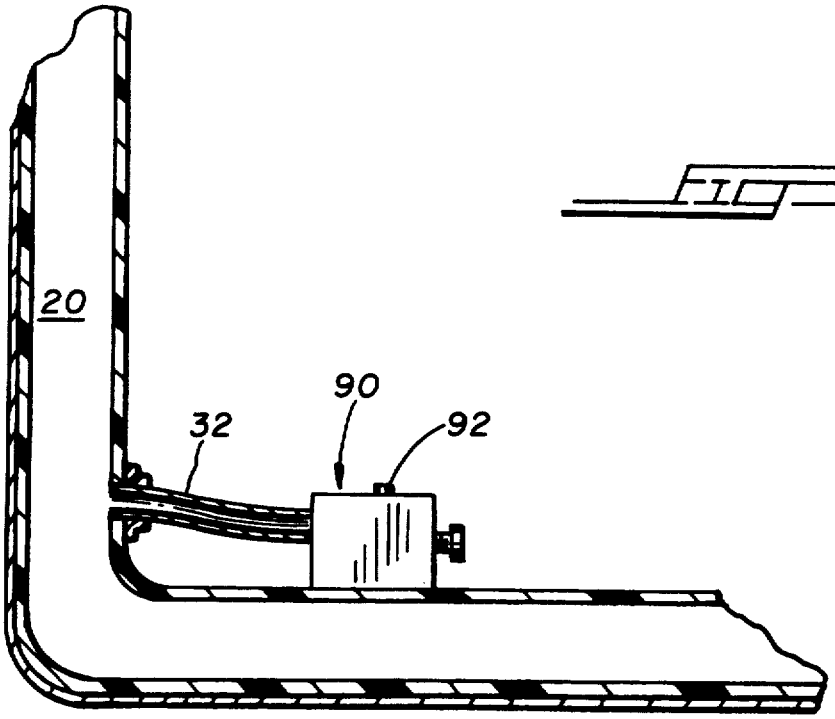
FIG. 7 is a cross-sectional view showing an electric pump for inflating the bag.

The pump for inflating the bag 10 may be a simple, conventional hand pump as shown in FIG. 6, with a relief valve 30' provided via a screw 31, that, when rotated, will evacuate the air chamber of its compressed air. Alternatively, an electric pump 90 may be provided, as shown in FIG. 7, which pump 90 is secured to the inner interior layer. The pump 90 may be battery operated, and has an on-off button 92.

While a specific embodiment of the invention has been shown and described, it is to be understood that numerous changes and modifications may be made therein without departing from the scope, spirit and intent of the invention as set forth in the appended claims.

What we claim is:

1. An inflatable garment bag comprising:

an outer shell-layer comprising an outer surface and an inner surface;

a first, outer, interior layer comprising an inner surface and an outer surface, portions of said outer surface of said first, interior layer being secured to portions of said inner surface of said outer shell-layer;

a second, inner, interior layer comprising an inner surface and an outer surface;

said first and second interior layers forming therebetween a sealed, annular air chamber for compressed air, and each said layer having an upper portion;

a front wall and a rear wall connected to said layers for forming an interior storage space;

each said layer comprising an upper through-opening;

a hanger-element having an exterior portion outside of said layers, and an interior portion inside said storage space, said hanger-element dimensioned for passage through each said through-opening of said layers;

said interior portion of said hanger-element comprising a pair of block elements, said pair of block elements comprising a lower block disposed inside the inner surface of said second interior layer and an upper block disposed outside the outer surface of said first interior layer, each said block having a vertically-aligned through-hole, a threaded shaft dimensioned for passage through each said through-hole of each said block and said layers, and means for urging said pair of block elements toward each other in clamping relationship; said pair of block elements clamping therebetween said upper portions of said first and second interior layers;

said lower block having a suspension means by which hangers may be suspended therefrom; and means for inflating said annular volume with compressed air, and for deflating said annular volume of the compressed air.

2. The inflatable garment bag according to claim 1, wherein said suspension means comprises a pair of vertical legs, said lower block having a pair of spaced-apart, vertical holes dimensioned for passage of said pair of vertical legs, and a pair of nuts for securing said pair of vertical legs; said lower block also having an upper surface face and a pair of recessed portions dimensioned for receiving said pair of nuts; said suspension means also having a horizontal bar between said pair of vertical legs and suspended below said lower block for suspending hangers therefrom.

3. The inflatable garment bag according to claim 1, wherein said means for inflating comprises a pump, a passageway from said pump to said annular chamber, said passageway having a first end connected to said pump and a second end secured to a portion of the interior surface of said inner, interior layer; said portion of said inner, interior layer having an opening for communicating between said passageway and said annular chamber.

4. The inflatable garment bag according to claim 1, wherein said exterior portion of said hanger-element comprises an eyelet at the upper end of said threaded shaft, and a hook portion connected to said eyelet, said hook portion comprising an upper hook for suspending the bag in a closet, and a lower loop for insertion in said eyelet, said loop comprising camming portions preventing the rotation of the hook portion in the lateral directions.

5. The inflatable garment bag according to claim 4, further comprising a stiffening member mounted between said outer protective layer and said upper portion of said outer, interior layer, said stiffening member having a hole dimensioned for passage of said threaded shaft.

6. The inflatable garment bag according to claim 1, further comprising a stiffening member mounted between said upper portion of said outer, protective layer and said upper portion of said outer, interior layer, said stiffening member having a hole dimensioned for passage of said threaded shaft.

7. The inflatable garment bag according to claim 6, wherein said exterior portion of said hanger-element comprises an eyelet at the upper end of said threaded shaft, and a hook portion connected to said eyelet, said hook portion comprising an upper hook for suspending the bag in a closet, and a lower loop for insertion in said eyelet, said loop comprising camming portions preventing the rotation of the hook portion in the lateral directions.

8. An inflatable garment bag comprising:

a first, outer layer comprising an inner surface and an outer surface;

a second, inner layer comprising an inner surface and an outer surface;

said first and second layers forming therebetween a sealed, annular air chamber for compressed air, and each said layer having an upper portion;

a front wall and a rear wall connected to said first and second layers for forming an interior storage space;

each of said first and second layers comprising an upper through-opening in vertical alignment with each other;

a hanger-element having an exterior portion outside of said first and second layers, and an interior portion inside said storage space, said exterior portion of said hanger-element comprising an upper block element disposed outside the outer surface of said first, outer layer;

said interior portion of said hanger-element comprising a lower block element disposed inside the inner surface of said second interior layer, each of said upper end lower block elements having a vertically-aligned through-hole; said hanger-element also comprising a shaft dimensioned for passage through each said through-hole of said block elements and said first and second layers, and means for urging said pair of block elements toward each other in clamping relationship; said pair of block elements clamping therebetween said upper portions of said first and second layers;

said lower block element having a suspension means by which hangers may be suspended therefrom; and means for inflating said annular volume with compressed air, and for deflating said annular volume of the compressed air;

said suspension means comprising a pair of vertical legs, said lower block element having a pair of spaced-apart, vertical holes dimensioned for passage of said pair of vertical legs, and a pair of nuts for securing said pair of vertical legs; said lower block element also having an upper surface face and a pair of recessed portions dimensioned for receiving said pair of nuts; said suspension means also having a horizontal bar between said pair of vertical legs and suspended below said lower block element for suspending hangers therefrom.

9. The inflatable garment bag according to claim 8, wherein said means for inflating comprises a pump, a passageway from said pump to said annular chamber, said passageway having a first end connected to said pump and a second end secured to a portion of the interior surface of said inner layer; said portion of said inner layer having an opening for communicating between said passageway and said annular chamber.

10. The inflatable garment bag according to claim 8, wherein said exterior portion of said hanger-element comprises an eyelet at the upper end of said shaft, and a hook portion connected to said eyelet, said hook portion comprising an upper hook for suspending the bag in a closet, and a lower loop for insertion in said eyelet, said loop comprising camming portions preventing the rotation of said hook portion in the lateral directions.

* * * * *